US006802959B1

(12) United States Patent
Brown

(10) Patent No.: US 6,802,959 B1
(45) Date of Patent: Oct. 12, 2004

(54) SEPARATION OF OLEFINIC HYDROCARBONS FROM SULFUR-CONTAINING HYDROCARBONS BY USE OF A SOLVENT

(75) Inventor: Ronald E. Brown, Bartlesville, OK (US)

(73) Assignee: ConocoPhillips Company, Houston, TX (US)

( * ) Notice: Subject to any disclaimer, the term of this patent is extended or adjusted under 35 U.S.C. 154(b) by 200 days.

(21) Appl. No.: 09/602,439

(22) Filed: Jun. 23, 2000

(51) Int. Cl.[7] ..... C10G 21/06; C10G 21/12

(52) U.S. Cl. ..... 208/311; 208/313; 208/322; 208/236; 208/237; 208/240; 208/809; 585/810; 585/833; 203/57; 203/58

(58) Field of Search ..... 208/313, 322, 208/237, 311, 236, 240; 585/809, 810, 833; 203/57, 58

(56) References Cited

U.S. PATENT DOCUMENTS

| | | | | | |
|---|---|---|---|---|---|
| 2,069,329 | A | * | 2/1937 | Roelfsema | 208/236 |
| 2,162,963 | A | * | 6/1939 | Mckittrick | 208/236 |
| 2,285,696 | A | | 6/1942 | Dunn et al. | 196/13 |
| 2,439,777 | A | * | 4/1948 | Lake et al. | 203/58 |
| 3,157,592 | A | * | 11/1964 | Fuerst | 208/324 |
| 3,242,227 | A | | 3/1966 | Kroeper | 260/681.5 |
| 3,673,081 | A | * | 6/1972 | Preusser et al. | 208/313 |
| 3,803,258 | A | * | 4/1974 | Weitz et al. | 585/862 |
| 4,053,369 | A | * | 10/1977 | Cines | 203/52 |
| 4,188,285 | A | | 2/1980 | Michlmayr | 208/246 |
| 4,421,640 | A | | 12/1983 | Watson et al. | 208/326 |
| 4,626,415 | A | * | 12/1986 | Tabak | 422/190 |
| 4,948,472 | A | * | 8/1990 | Lee et al. | 203/55 |
| 4,954,224 | A | * | 9/1990 | Brown et al. | 203/51 |
| 5,055,162 | A | * | 10/1991 | Brown et al. | 208/56 |
| 5,135,617 | A | | 8/1992 | Brown et al. | 203/56 |
| 5,454,933 | A | | 10/1995 | Savage et al. | 208/212 |
| 5,494,572 | A | | 2/1996 | Horii et al. | 208/236 |
| 5,582,714 | A | * | 12/1996 | Forte | 208/237 |
| 5,753,102 | A | * | 5/1998 | Funakoshi et al. | 208/208 R |
| 5,863,419 | A | | 1/1999 | Huff, Jr. et al. | 208/237 |
| 6,184,176 | B1 | * | 2/2001 | Khare | 502/407 |
| 6,228,254 | B1 | * | 5/2001 | Jossens et al. | 208/212 |
| 6,358,402 | B1 | * | 3/2002 | Schucker | 208/237 |

OTHER PUBLICATIONS

PCT Application WO97/47707, Vicari et al., published Dec. 18, 1997 in German. English translation to be forwarded in due course.

* cited by examiner

*Primary Examiner*—Walter D. Griffin
*Assistant Examiner*—Tam M. Nguyen
(74) *Attorney, Agent, or Firm*—Jeffrey R. Anderson

(57) ABSTRACT

A process for separating olefins from sulfur-containing hydrocarbons contained in a hydrocarbon feedstock is disclosed and includes contacting the hydrocarbon feedstock with N-hydroxyethyl pyrollidone in a contacting zone, removing at least one olefin overhead from the contacting zone, and removing at least a portion of the sulfur-containing hydrocarbons off the bottom of the contacting zone along with the N-hydroxyethyl pyrollidone.

18 Claims, 1 Drawing Sheet

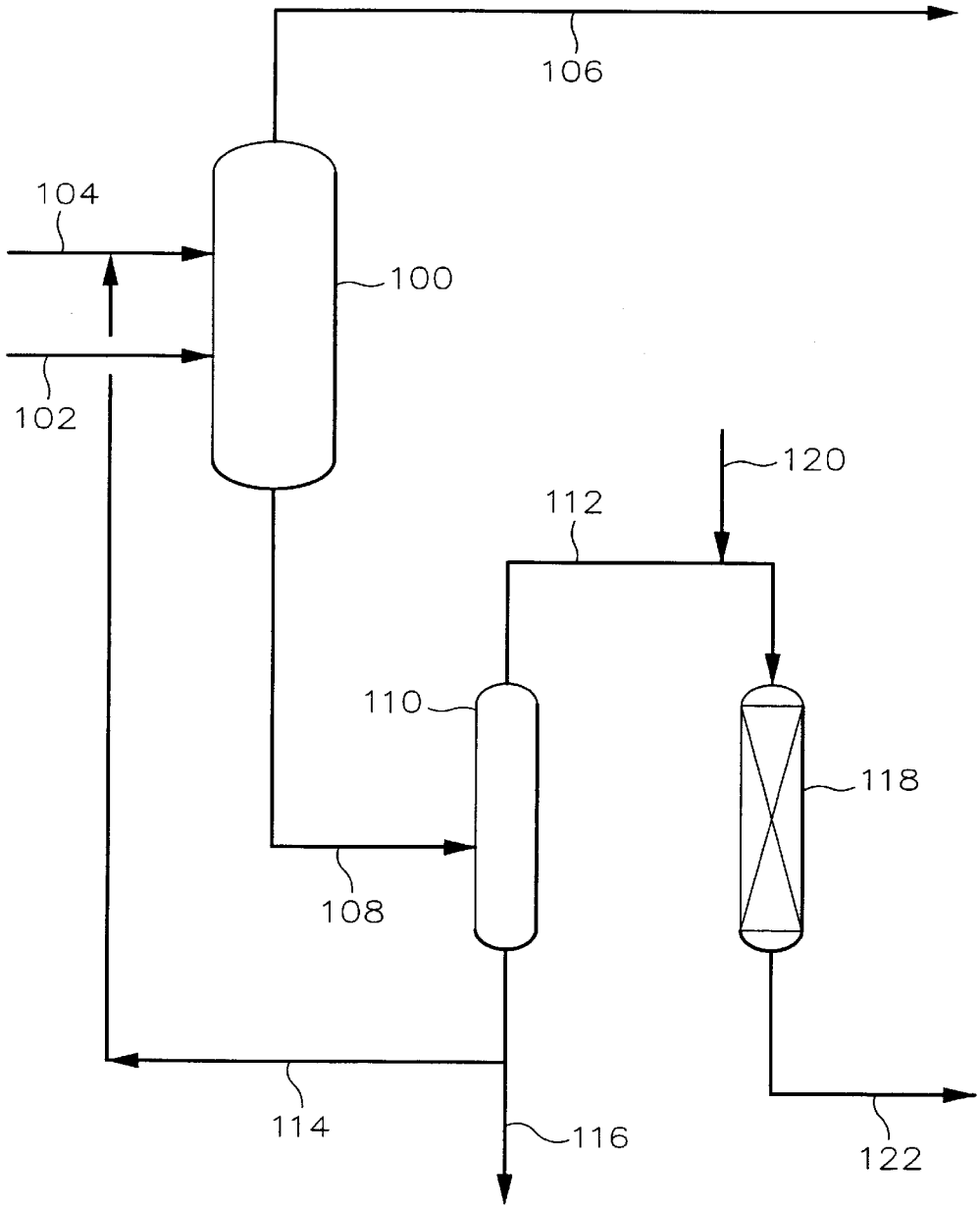
106
104
100
102
120
112
110
118
108
114
116
122

SEPARATION OF OLEFINIC HYDROCARBONS FROM SULFUR-CONTAINING HYDROCARBONS BY USE OF A SOLVENT

BACKGROUND OF THE INVENTION

This invention relates to the separation of olefinic hydrocarbons from close-boiling sulfur-containing hydrocarbons by use of a solvent.

Removal of sulfur, in the form of sulfur-containing hydrocarbons, from a hydrocarbon stream such as a cracked gasoline, is normally accomplished by hydrogenation of the sulfur to hydrogen sulfide. Proposed environmental regulations requiring lower sulfur concentrations in gasoline (possibly as low as 30 ppm) have made such sulfur removal even more critical and commercially important than ever before. However, hydrogenation of hydrocarbon streams containing sulfur-containing hydrocarbons and olefins results in the saturation of olefins, with a resulting costly loss in octane rating. Therefore, a process for separating olefins from sulfur-containing hydrocarbons, allowing hydrogenation of the sulfur-containing hydrocarbons without the costly hydrogenation (saturation) of olefins, would be a significant contribution to the art and to the economy.

SUMMARY OF THE INVENTION

It is an object of this invention to provide a process for separating at least one olefin from at least one sulfur-containing hydrocarbon.

It is another object of this invention to provide a process for separating at least one olefin from at least one sulfur-containing hydrocarbon using a solvent.

It is still another object of this invention to provide a process for separating at least one olefin from at least one sulfur-containing hydrocarbon using a solvent in an extractive distillation process.

It is yet another object of this invention to provide a process for separating at least one olefin from at least one sulfur-containing hydrocarbon using a solvent, such as N-hydroxyethyl pyrollidone.

It is a further object of this invention to provide a process for separating at least one olefin from a thiophenic compound.

It is another object of this invention to provide a process for desulfurizing a cracked gasoline without saturating olefins contained therein.

In accordance with the present invention, a process is provided including the steps of:

a) contacting a hydrocarbon feedstock comprising at least one olefin and at least one sulfur-containing hydrocarbon with a solvent stream comprising N-hydroxyethyl pyrollidone in a contacting zone; and b) removing a first overhead stream comprising at least a portion of the at least one olefin from the contacting zone.

Other objects and advantages will become apparent from the detailed description and the appended claims.

BRIEF DESCRIPTION OF THE DRAWING

FIG. 1 is a simplified flow scheme of an embodiment of the present invention.

DETAILED DESCRIPTION OF THE INVENTION

The hydrocarbon feedstock suitable for use in the present invention comprises, consists of, or consists essentially of at least one olefin and at least one sulfur-containing hydrocarbon. The at least one olefin preferably has in the range of from 2 to 8, more preferably from 6 to 8, and most preferably from 7 to 8 carbon atoms per molecule, and is a mono-olefin, di-olefin, tri-olefin, cycloalkene, or a combination of any two or more thereof.

Suitable hydrocarbon feedstocks include, but are not limited to, gasoline range hydrocarbons such as catalytically cracked gasolines and fractions thereof (e.g., FCC and hydrocracking) processes, pyrolysis gasolines from thermal hydrocarbon (e.g., ethane, propane, and naphtha) cracking processes, naphthas, gas oils, reformates, straight-run gasoline and the like. The preferred feed is a catalytically cracked gasoline comprising hydrocarbons having from 2 to 30 carbon atoms per molecule.

The hydrocarbon feedstock typically comprises at least about 20 ppmw sulfur. More typically, the concentration of sulfur will be in the range of from about 100 ppmw to about 3000 ppmw, and most typically the sulfur content will be in the range of from 200 ppmw to 1000 ppmw. Sulfur ppmw, as used herein, means the parts per million by weight of atomic sulfur contained in a hydrocarbon stream. The sulfur is generally present in the hydrocarbon feedstock in the form of sulfur-containing hydrocarbons. The at least one sulfur-containing hydrocarbon typically contains in the range of from 4 to 8 carbon atoms per molecule, and is most typically a thiophenic compound, such as, but not limited to, thiophene, 2-methyl thiophene, 3-methyl thiophene, or combinations thereof.

The olefin concentration of the hydrocarbon feedstock is typically in the range of from about 10 wt. % to about 50 wt %, more typically from about 15 wt. % to about 35 wt. %, and most typically from 20 wt. % to 30 wt. % of the hydrocarbon feedstock.

The aromatic hydrocarbon content of the hydrocarbon feedstock is typically in the range of from about 5 wt. % to about 30 wt. %, more typically in the range of from about 10 wt. % to about 25 wt. %, and most typically from 10 wt. % to 20 wt. % of the hydrocarbon feedstock.

The at least one olefin and at least one sulfur-containing hydrocarbons of the hydrocarbon feedstock can be separated from each other by contacting the hydrocarbon feedstock with a solvent stream comprising, consisting of, or consisting essentially of N-hydroxyethyl pyrollidone in a contacting zone. A first overhead stream comprising, consisting of, or consisting essentially of at least a portion of the at least one olefin can be removed from the contacting zone and a first bottoms stream comprising, consisting of, or consisting essentially of at least a portion of the N-hydroxyethyl pyrollidone and at least a portion of the at least one sulfur-containing hydrocarbon can be removed from the contacting zone.

The concentration of sulfur-containing hydrocarbons in the first overhead stream is preferably lower then the concentration of sulfur-containing hydrocarbons in the hydrocarbon feedstock, more preferably, the first overhead stream is substantially free of sulfur-containing hydrocarbons, and most preferably, the concentration of sulfur-containing hydrocarbons in the first overhead stream is less than 100 ppmw. Any remaining sulfur-containing hydrocarbons are likely non-thiophenic and can be removed from the first overhead stream by use of treatment processes such as, but not limited to, caustic washing.

The contacting zone for contacting the hydrocarbon feedstock with the solvent stream is preferably an extractive distillation column (EDC) wherein the solvent is charged to the EDC at a location above that location where the hydrocarbon feedstock is charged to the EDC. The at least one sulfur-containing hydrocarbon leaves the EDC through a first bottoms stream while the at least one olefin passes out of the EDC in a first overhead stream. The following reference provides a description of extractive distillation: "Perry's Chemical Engineers Handbook", 6th Edition, McGraw-Hill Book Company, 1984, pages 13–53 to 13–57.

The first bottoms stream can be separated into a second overhead stream comprising at least a portion of the at least one sulfur-containing hydrocarbon, and into a second bottoms stream comprising at least a portion of the N-hydroxyethyl pyrollidone. The second bottoms stream can be recycled to the contacting zone for use as at least a portion of the solvent stream.

In one embodiment, the hydrocarbon feedstock and the second overhead stream are further characterized to comprise at least one heavy hydrocarbon having greater than seven carbon atoms per molecule which are also selected from the group consisting of paraffins, aromatics, and combinations thereof. In accordance with this embodiment, the second overhead stream can be hydrodesulfurized, in the presence of hydrogen and under hydrodesulfurization conditions, to thereby produce a desulfurized heavy hydrocarbon product.

Preferably, when the hydrocarbon feedstock is a cracked gasoline, the combined Research Octane Number (RON) of the first overhead stream and the desulfurized heavy hydrocarbon product is at least substantially the same as the RON of the hydrocarbon feedstock. Preferably, the combined RON of the first overhead stream and the desulfurized heavy hydrocarbon product is within 0.5 octane numbers of the RON of the hydrocarbon feedstock, as determined using ASTM test method D2699-97ae1.

The concentration of sulfur in the combined first overhead stream and desulfurized heavy hydrocarbon product is preferably less than about 50 ppmw, more preferably less than about 40 ppmw, and most preferably less than 30 ppmw.

Referring now to the FIGURE, a hydrocarbon feedstock enters a contacting vessel 100, which defines a contacting zone, via conduit 102 and a solvent stream enters contacting vessel 100 via conduit 104. A first overhead stream is removed from contacting vessel 100 via conduit 106 and a first bottoms stream is removed from contacting vessel 100 via conduit 108. The first bottoms stream is charged to a separator 110 via conduit 108. A second overhead stream is withdrawn from separator 110 via conduit 112 and a second bottoms stream is removed from separator 110 via conduit 114 and is recycled to contacting vessel 100 via conduits 114 and 104 for use as a part of the solvent stream. From time to time, impurities which build up in the system can be removed from the system by removing a small purge stream via conduit 116. The second overhead stream is charged to a hydrodesulfurization reactor 118 via conduit 112, and a hydrogen containing stream is charged to hydrodesulfurization reactor 118 via conduits 120 and 112 wherein the second overhead stream is desulfurized producing a desulfurized heavy hydrocarbon product which is removed from hydrodesulfurization reactor 118 via conduit 122. The hydrodesulfurization reactor 118 can be operated in upflow or downflow mode.

The following examples are provide to further illustrate this invention and are not to be considered as unduly limiting the scope of this invention.

EXAMPLE I

This example demonstrates the relative volatility enhancement N-hydroxyethyl pyrollidone provides in separating thiophene and octene-1 in a binary system.

To a 20 gram quantity of a hydrocarbon mixture of 50 wt. % octene-1 and 50 wt. % thiophene was added the solvent N-hydroxyethyl pyrollidone at various solvent/feed wt. ratios to form solvent/hydrocarbon mixtures. The relative volatility (octene-1/thiophene) was separately determined for each solvent/hydrocarbon mixture by the following method.

Each solvent/hydrocarbon mixture was separately heated under reflux conditions for about 20–30 minutes in a distillation flask equipped with a reflux condenser. A small sample (about 0.5 g) was withdrawn by means of a septum from the flask containing the liquid phase of the equilibrium system, and a sample of the condensed vapor was withdrawn by means of a septum located just below the reflux condenser. Both samples were analyzed, and the mole fractions of octene-1 and thiophene in the liquid phase and in the vapor phase were determined by means of a gas chromatograph. The relative volatility R was calculated as follows:

$$R = \frac{Y1/X1}{Y2/X2},$$

wherein Y1 and Y2 are the mole fractions of octene-1 and thiophene, respectively, in the vapor phase; and X1 and X2 are the mole fractions of octene-1 and thiophene, respectively, in the liquid phase. Test results are summarized in Table 1.

TABLE I

| Solvent/Feed wt. ratio | Relative Volatility* |
|---|---|
| 0 | 0.5 |
| 1 | 0.7 |
| 2 | 1.0 |
| 3 | 1.2 |
| 5 | 1.7 |

*(octene-1/thiophene)

The data in Table 1 show that with increasing solvent/feed wt. ratio, the relative volatility of octene-1/thiophene increases. A relative volatility of greater than 1.0 for octene-1/thiophene means that octene-1 has a higher volatility as compared to thiophene, and the octene-1 will separate overhead with the thiophene taken off the bottom (which is preferred in the present invention). At a relative volatility (octene-1/thiophene) of less than 1.0, the thiophene volatility is higher than the octene-1 volatility and the thiophene will pass overhead with the octene-1 taken off the bottom. As relative volatility increases above 1.0, the relative volatility is reversed and octene-1 will be taken overhead and thiophene will be taken off the bottom. Also, as the relative volatility increases above 1.0, the separation of the two components is made easier (that is, with less equilibrium stages). Thus, at a solvent/feed wt. ratio of 5 or more, the relative volatility of octene-1/thiophene is 1.7 which results in an easier separation of octene-1 and thiophene (approximately six equilibrium stages), as compared to the separation of octene-1 and thiophene at a relative volatility of only 1.2 which requires 20 equilibrium stages.

EXAMPLE II

This example demonstrates the use of N-hydroxyethyl pyrollidone as a solvent to remove sulfur-containing hydrocarbons from a catalytically cracked gasoline.

The solvent N-hydroxyethyl pyrollidone was added to a 20 gram quantity of a catalytically cracked gasoline obtained from a petroleum refinery in a distillation flask equipped with a reflux condenser at various solvent/gasoline wt. ratios.

The distillation flask contents were heated under reflux conditions for about 20–30 minutes. A small sample (about 0.5 g) was withdrawn by means of a septum from the flask containing the liquid phase of the equilibrium system, and a sample of the condensed vapor was withdrawn by means of a septum located just below the reflux condenser. The gasoline feed and both samples (vapor and liquid) were analyzed for total olefins (containing in the range of from 4 to 12 carbon atoms per molecule), thiophene, 2-methyl thiophene, and 3-methyl thiophene by means of a gas chromatograph.

The mole fractions of the total olefins and the combined thiophenic compounds (thiophene, 2-methyl thiophene and 3-methyl thiophene) in the liquid phase and in the vapor phase were determined by means of a gas chromatograph. The relative volatility R was calculated as follows:

$$R = \frac{Y1/X1}{Y2/X2},$$

wherein Y1 and Y2 are the mole fractions of total olefins and thiophenic compounds, respectively, in the vapor phase; and X1 and X2 are the mole fractions of total olefins and thiophenic compounds respectively, in the liquid phase. Test results are summarized in Table 2.

TABLE 2

| | | Solvent/Feed wt. ratio = 0 | | | Solvent/Feed wt. ratio = 5 | | |
|---|---|---|---|---|---|---|---|
| Component (ppmw) | Feed Gasoline | Over-head Stream | Bottoms Stream | % Reduction in Overhead Stream* | Over-head Stream | Bottoms Stream | % Reduction in Overhead Stream* |
| thiophene | 25 | 25 | 0 | 0 | 9 | 16 | 64 |
| 2-methyl thiophene | 17 | 17 | 0 | 0 | 7 | 10 | 59 |
| 3-methyl thiophene | 20 | 20 | 0 | 0 | 8 | 12 | 60 |
| Relative Volatility** | — | | 2.1 | | | 5.9 | |

*Represents the % reduction of thiophene, 2-methyl thiophene or 3-methyl thiophene levels in the overhead stream as compared to the feed gasoline levels and is calculated as follows: (ppmw in feed gasoline - ppmw in overhead stream)/ppmw in feed gasoline.
**(Total olefins/thiophenic compounds) Thiophenic compounds = thiophene, 2-methyl thiophene, and 3-methyl thiophene
Total olefins = olefins containing in the range of from 4 to 12 carbon atoms per molecule.

The data in Table 2 show that with a solvent/feed wt. ratio of 5, and just one equilibrium stage, significant reductions in thiophene, 2-methyl thiophene and 3-methyl thiophene concentrations were observed in the overhead stream whereas no reductions in these concentrations in the overhead stream were observed at a solvent/feed wt. ratio of 0.

At a solvent/feed wt. ratio of 5, the concentrations of thiophene, 2-methyl thiophene and 3-methyl thiophene in the overhead stream were 64%, 59% and 60%, respectively, lower than such concentrations in the gasoline feed. The lower concentrations of these thiophenic compounds in the overhead, and the corresponding higher concentrations of thiophenic compounds in the bottoms stream, allow the treatment of the majority of the thiophenic compounds by hydrodesulfurization of the bottoms stream.

Also, due to the high relative volatility of total olefins/thiophenic compounds (5.92) at a solvent/feed wt. ratio of 5, most, if not all, of the olefins present in the feed gasoline will pass with the overhead stream, thus avoiding saturation of the olefins in the hydrodesulfurization process required to treat the thiophenic compounds.

Reasonable variations, modifications, and adaptations can be made within the scope of the disclosure and the appended claims without departing from the scope of this invention.

That which is claimed is:

1. A process for separating at least one olefin from at least one sulfur-containing hydrocarbon comprising the steps of:

a) contacting a hydrocarbon feedstock, the total olefinic content of which is limited to olefins selected from the group consisting of mono-olefins having from 2 to 8 carbon atoms per molecule, di-olefins having from 6 to 8 carbon atoms per molecule, tri-olefins having from 2 to 8 carbon atoms per molecule, and combinations of any two or more thereof, and further comprising at least one sulfur-containing hydrocarbon, with a solvent stream comprising N-hydroxyethyl pyrollidone in a contacting zone; and b) removing a first overhead stream comprising at least a portion of said at least one olefin from said contacting zone.

2. A process in accordance with claim 1 wherein said hydrocarbon feedstock is a catalytically cracked gasoline.

3. A process in accordance with claim 1 wherein the concentration of sulfur-containing hydrocarbons in said first overhead stream is lower than the concentration of sulfur-containing hydrocarbons in said hydrocarbon feedstock.

4. A process in accordance with claim 1 wherein said at least one sulfur-containing hydrocarbon contains in the range of from 4 to 8 carbon atoms per molecule.

5. A process in accordance with claim 1 wherein said at least one sulfur-containing hydrocarbon comprises a thiophenic compound.

6. A process in accordance with claim 1 further characterized to include the step of:

c) removing a first bottoms stream comprising at least a portion of said N-hydroxyethyl pyrollidone and at least a portion of said at least one sulfur-containing hydrocarbon.

7. A process in accordance with claim 6 wherein said first bottoms stream is separated into a second overhead stream comprising at least a portion of said at least one sulfur-containing hydrocarbon, and into a second bottoms stream comprising at least a portion of said N-hydroxyethyl pyrollidone; and wherein at least a portion of said second bottoms stream is used as at least a portion of said solvent stream.

8. A process for separating at least one olefin from at least one sulfur-containing hydrocarbon comprising the steps of:

a) contacting a hydrocarbon feedstock comprising at least one olefin and at least one sulfur-containing hydrocarbon with a solvent stream consisting essentially of N-hydroxyethyl pyrollidone in a contacting zone; and b) removing a first overhead stream comprising at least a portion of said at least one olefin from said contacting zone.

9. A process in accordance with claim 8 wherein said hydrocarbon feedstock is a catalytically cracked gasoline.

10. A process in accordance with claim 8 wherein the concentration of sulfur-containing hydrocarbons in said first overhead stream is lower than the concentration of sulfur-containing hydrocarbons in said hydrocarbon feedstock.

11. A process in accordance with claim 8 wherein said at least one olefin is selected from the group consisting of mono-olefins, di-olefins or tri-olefins containing in the range of from 2 to 8 carbon atoms per molecule, and combinations of any two or more thereof.

12. A process in accordance with claim 8 wherein said at least one sulfur-containing hydrocarbon contains in the range of from 4 to 8 carbon atoms per molecule.

13. A process in accordance with claim 8 wherein said at least one sulfur-containing hydrocarbon comprises a thiophenic compound.

14. A process in accordance with claim 8 further characterized to include the step of:

c) removing a first bottoms stream comprising at least a portion of said N-hydroxyethyl pyrollidone and at least a portion of said at least one sulfur-containing hydrocarbon.

15. A process in accordance with claim 14 wherein said first bottoms stream is separated into a second overhead stream comprising at least a portion of said at least one sulfur-containing hydrocarbon, and into a second bottoms stream comprising at least a portion of said N-hydroxyethyl pyrollidone; and wherein at least a portion of said second bottoms stream is used as at least a portion of said solvent stream.

16. A process for desulfurizing cracked gasoline comprising the steps of:

a) contacting a hydrocarbon feedstock comprising cracked gasoline comprising at least one olefin and at least one sulfur-containing hydrocarbon with a solvent stream consisting essentially of N-hydroxyethyl pyrollidone in a contacting zone;

b) removing a first overhead stream comprising at least a portion of said at least one olefin from said contacting zone;

c) removing a first bottoms stream comprising at least a portion of said N-hydroxyethyl pyrollidone and at least a portion of said at least one sulfur-containing hydrocarbon;

d) separating said first bottoms stream into a second overhead stream comprising at least a portion of said at least one sulfur-containing hydrocarbon, and into a second bottoms stream comprising at least a portion of said N-hydroxyethyl pyrollidone; and e) utilizing at least a portion of said second bottoms stream as at least a portion of said solvent stream.

17. A process in accordance with claim 16 wherein said hydrocarbon feedstock and said second overhead stream are further characterized to comprise at least one heavy hydrocarbon having greater than seven carbon atoms per molecule, and wherein said process is further characterized to include hydrodesulfurizing said second overhead stream to produce a desulfurized heavy hydrocarbon product.

18. A process in accordance with claim 16 wherein the combined octane rating of said first overhead stream and said desulfurized heavy hydrocarbon product is at least substantially the same as the octane rating of said hydrocarbon feedstock.

* * * * *